US008283613B2

(12) United States Patent
Tain et al.

(10) Patent No.: US 8,283,613 B2
(45) Date of Patent: Oct. 9, 2012

(54) HEAT-PIPE ELECTRIC-POWER GENERATING DEVICE

(75) Inventors: Ra-Min Tain, Taipei County (TW); Shu-Jung Yang, Tainan County (TW); Yu-Lin Chao, Hsinchu (TW); Yao-Shun Chen, Hsinchu County (TW); Shyi-Ching Liau, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 1257 days.

(21) Appl. No.: 11/562,420

(22) Filed: Nov. 22, 2006

(65) Prior Publication Data

US 2007/0151969 A1 Jul. 5, 2007

(30) Foreign Application Priority Data

Jan. 5, 2006 (TW) ..... 95100434 A

(51) Int. Cl.

| | |
|---|---|
| ***H05B 6/10*** | (2006.01) |
| ***F03C 1/00*** | (2006.01) |
| ***F01K 23/06*** | (2006.01) |
| ***H02K 5/12*** | (2006.01) |
| ***H02K 49/00*** | (2006.01) |

(52) U.S. Cl. ..... 219/631; 60/531; 60/670; 310/86; 310/103

(58) Field of Classification Search ..... 219/629, 219/630, 631, 628; 60/531, 650, 651, 669, 60/670, 671; 310/38; 165/104.26
See application file for complete search history.

(56) References Cited

U.S. PATENT DOCUMENTS 3,842,596 A * 10/1974 Gray ..... 60/736
4,186,559 A * 2/1980 Decker et al. ..... 60/531
4,262,483 A * 4/1981 DeGeus ..... 60/641.8
5,085,948 A * 2/1992 Tsukamoto et al. ..... 429/11
6,011,334 A * 1/2000 Roland ..... 310/86
6,384,320 B1 * 5/2002 Chen ..... 136/259

FOREIGN PATENT DOCUMENTS

CN 1065953 C 5/2001
CN 1764815 4/2006

(Continued)

OTHER PUBLICATIONS

"Office Action of Taiwan counterpart application", issued on Dec. 22, 2009, p. 1-p. 4.
"2nd Office Action of China counterpart application", issued on Nov. 20, 2009, p. 1-p. 5.
"1st Office Action of China counterpart application", issued on May 22, 2009, p. 1-p. 5.

(Continued)

*Primary Examiner* — Henry Yuen
*Assistant Examiner* — Hung D Nguyen
(74) *Attorney, Agent, or Firm* — Jianq Chyun IP Office

(57) ABSTRACT

A heat-pipe electric-power generating device capable of converting thermal energy to electrical energy is provided. The device includes a heat pipe and the heat pipe has a sealed internal space that can produce a steam-flow from an evaporating end to a condensing end according to a pressure difference caused by a temperature difference between the ends. A steam-flow electric-power generating device has at least a rotating portion disposed in the internal space for generating electric power when driven by a steam-flow. An electrode structure is used for leading the electric power out. The heat pipe is maintained in a sealed condition. In addition, several heat-pipe electric-power generating devices can be arranged into an array to form a heat electric-power generator or disposed inside an apparatus with a heat source for recycling the conventional waste thermal energy into useful electrical energy.

17 Claims, 8 Drawing Sheets

FOREIGN PATENT DOCUMENTS

| | | | | |
|---|---|---|---|---|
| DE | 2751530 | | | 5/1979 |
| JP | 58-119906 | | | 7/1983 |
| JP | 61-255202 | | | 11/1986 |
| JP | 62026306 | A | * | 2/1987 |
| JP | 6-113597 | | | 4/1994 |
| TW | 200809085 | | | 2/2008 |

OTHER PUBLICATIONS

"3rd Office Action of China counterpart application", issued on Mar. 31, 2010, p. 1-p. 4.

"4th Office Action of China Counterpart Application" issued on Sep. 9, 2010, p. 1-p. 3, in which the listed reference was cited.

* cited by examiner

HEAT-PIPE ELECTRIC-POWER GENERATING DEVICE

CROSS-REFERENCE TO RELATED APPLICATION

This application claims the priority benefit of Taiwan application serial no. 95100434, filed Jan. 5, 2006. All disclosure of the Taiwan application is incorporated herein by reference.

BACKGROUND OF THE INVENTION

1. Field of the Invention

The present invention relates to a technique for converting thermal energy to electrical energy, and more particularly, to a heat-pipe electric-power generating device that can be disposed inside an apparatus for recycling heat energy or energy from a heat source and forming a heat electric-power generator.

2. Description of Related Art

Energy is an indispensable commodity in our daily life. In general, energy can exist in many forms, the most common forms includes heat energy, electrical energy and light energy. From the perspective of the energy, heat energy or electrical energy brings out some beneficial effects. However, some form of energy becomes waste energy and is simply discarded to the surrounding because the conversion efficiency is too low to be of much use. For example, an electronic device uses electrical energy to perform a number of operations and generates some waste heat. The waste heat is simply dissipated to the surrounding and never utilized. Furthermore, if the energy is present as light energy or heat energy but the required energy is electrical energy, an efficient energy conversion apparatus or system is required.

The most widely used conventional energy source such as petroleum is increasingly scarce and will be in short supply soon. Therefore, finding a new energy source and recycling some of the energy is an important topic. Another form of energy, which is unlimited in supply and entirely different from that provided by the petroleum industry, is the solar energy. In general, solar energy can be converted to heat energy and electrical energy.

Accordingly, collecting waste heat and converting the waste heat into useful energy is always everyone's concern in the current energy crisis. Therefore, the provision of a design capable of efficiently converting a heat source into an electrical source to meet a variety of energy applications is in the mind of most energy researchers.

SUMMARY OF THE INVENTION

Accordingly, the present invention might provide a heat-pipe electric-power generating device that can efficiently utilize the heat such as waste heat from a heat source and convert the heat into electric power so that the waste heat is recycled. Alternatively, the heat energy (source) is directly converted into usable electrical energy.

The present invention might also provide a heat electric-power generator that utilizes a plurality of the foregoing heat-pipe electric-power generating devices for generating electric power from heat energy.

The present invention might further provide an apparatus with heat energy (source) recycling capacity. The apparatus has a unit comprising a plurality of the foregoing heat-pipe electric-power generating devices for converting waste heat into electrical energy and recycling this electrical energy.

As embodied and broadly described herein, the invention provides a heat-pipe electric-power generating device capable of converting heat energy into electrical energy. The device includes a heat pipe and the heat pipe has a sealed internal space that can produce a steam-flow from an evaporating end to a condensing end according to a pressure difference. A steam-flow electric-power generating device has at least a rotating portion disposed in the internal space for generating electric power when driven by a steam-flow. An electrode structure is coupled to the steam-flow electric-power generating device for leading the electric power out.

The present invention also provides a heat electric-power generator having an accommodating unit with a heat source reception surface. The heat source reception surface has a plurality of accommodating slots distributed thereon. The foregoing heat-pipe electric-power generating devices are disposed in the accommodating slots. Furthermore, an electrical energy collector is also disposed to combine the electrical energy from each of the heat-pipe electric-power generating devices before the electrical energy is output.

The present invention also provides an apparatus with heat source (energy) recycling capacity. The apparatus includes a main unit for executing a predetermined function. The main unit generates a waste heat source. At least one of the foregoing heat-pipe electric-power generating devices utilizes the waste heat source as a heat source for converting into a recycled electric-power source.

Accordingly, the present invention uses a heat pipe with heat dissipating capacity and disposes a steam-flow electric-power generating device inside the heat pipe. Using a gas flow such as a steam flow inside the heat pipe, the device is propelled to generate electricity. Through the electrodes fabricated using the thermal sintering technique, electrical energy generated by the device is channeled out.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
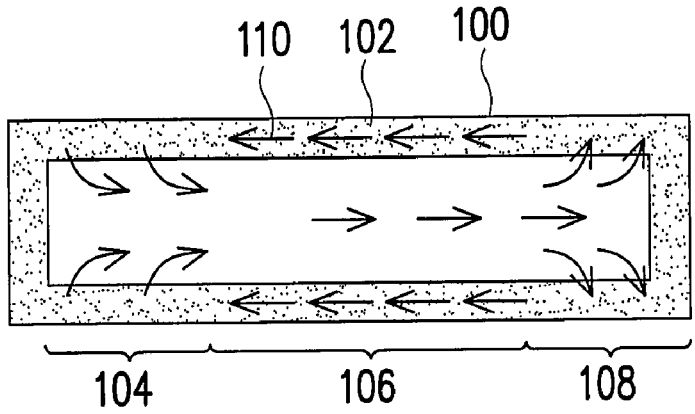
FIG. 1 (PRIOR ART)
FIG. 1 is a schematic cross-sectional view of a conventional heat pipe.

Reference will now be made in detail to the present preferred embodiments of the invention, examples of which are illustrated in the accompanying drawings. Wherever possible, the same reference numbers are used in the drawings and the description to refer to the same or like parts.

In considering a few of the conventional designs of heat apparatus, heat pipe is one of the most common options. After doing some research on some conventional heat pipe mechanisms, the present invention moves forward a step to produce a device having electric power generating capability. A few embodiments are discussed in the following. However, the scope of the present invention is not limited to those described below.

First, the heat transfer mechanism of the heat pipe is discussed. FIG. 1 is a schematic cross-sectional view of a conventional heat pipe. A wall casing 100 encloses a sealed space to form a pipe. The sealed space is pre-filled with a heating medium at a low pressure. According to the latent heat variation characteristic between the gas phase and the liquid phase, a low saturated vapor pressure can lower the temperature of vaporization of the liquid and facilitate the condensation of vapor into liquid at the same time. The condensation of gaseous vapor can release heat while the vaporization of liquid can absorb heat. Therefore, the heat pipe is generally divided into three regions, namely, an evaporating end 104, a middle section 106 and a condensing end 108. The filled material can condense into liquid in the capillary space inside the heat pipe and then the liquid is directed to the evaporating end 104 through the wall casing 100 whose material 102 can produce capillary effect. For example, after the evaporating end 104 is heated, it will remain in a relatively high-temperature and high-pressure condition, comparing to the condensing end 108. In the process of heating the evaporating end 104, the liquid in the evaporating end 104 is activated to a critical zone for latent change. If the temperature of the liquid is raised to a level above the critical temperature, the liquid is vaporized into gas. Since the volume in the gas phase is considerably larger than the volume in the liquid phase, the evaporation of a minute quantity of liquid into gas can produce a strong steam flow toward the condensing end 108. After the energy of the gas is released at the condensing end 108 and condenses back to liquid, the liquid flows back to the evaporating end 104 in a recycling path indicated by the arrows 110.

One of the most common applications of the heat pipe is, for example, dissipating the waste heat of an apparatus. Since the one in ordinary skill of the art should be familiar to the basic theory of operation and structure of a conventional heat pipe, a detailed description is omitted.

Figure 2:
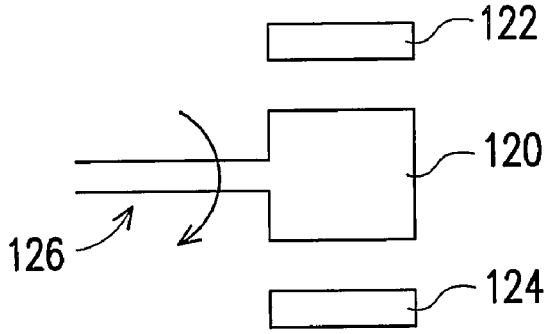
FIG. 2 (PRIOR ART)
FIG. 2 is a diagram of a conventional electric generator.

In the present invention, a conventional electric power generator such as the one shown FIG. 2 can be used to generate electric power. As shown in FIG. 2, the electric power generator has a rotating winding 120. In the presence of a magnetic field, for example, provided by a pair of magnets 122 and 124, the winding 120 can produce an electric current led out through a pair of electrodes 126. This is the basic operating principle of an electric generator. In fact, the same mechanism deployed by most power generation plants.

After considering the basic mechanism of generating heat energy and electrical energy, an innovative heat-pipe electric-power generating device is proposed in the present invention. The device collects the heat energy, for example, the waste heat produced by any devices or the heat energy produced by solar power conversion and converts the heat energy into electrical energy. In particular, the device provides an effective method of recycling waste heat. Even, the heat generated by burning garbage can be converted into useful electric power.

Figure 3:
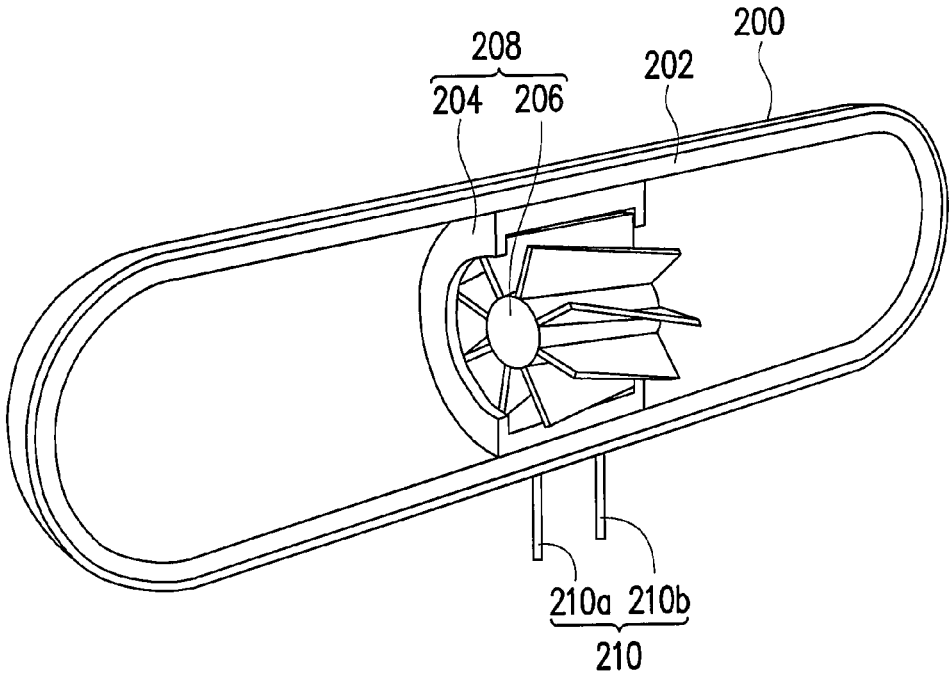
FIG. 3 is a perspective view of a cut-out section of a heat-pipe electric-power generating device according to one embodiment of the present invention.

FIG. 3 is a perspective view of a cut-out section of a heat-pipe electric-power generating device according to one embodiment of the present invention. As shown in FIG. 3, the heat-pipe electric-power generating device includes an outer wall 200 enclosing a sealed space to form a pipe. The inner surface of the outer wall 200 has an inner wall 202. The inner wall 202 is fabricated using a material capable of producing the capillary effect or a porous material that allows liquid to seep through. The outer wall 200 and the inner wall 202 together form the heat pipe. A fluid having a low saturated vapor pressure such as water or other liquid fills the interior of the heat pipe. Thus, a common heat pipe having a mechanism identical to the one described in FIG. 1 is produced.

According to the consideration of the present invention, a steam-flow electric-power generating device 208 is set up in the middle section 106 inside the heat pipe (refer to FIG. 1). The steam-flow electric-power generating device 208 can be, for example, a micro-device when the size of the heat pipe is in a micro-scale. The present invention is not necessary to be limited to the micro-device. However, in the embodiment, the micro-device is used as the example for description. The steam-flow electric-power generating micro-device 208 includes a magnetic unit 204 capable of producing a permanent magnetic field for generating electric power. The magnetic unit 204 is fixed on the inner wall 202 and located in the middle section of the heat pipe, for example. Furthermore, the steam-flow electric-power generating micro-device 208 includes a turbine electric-power generating unit 206 that utilizes steam flow to rotate the winding (not shown in FIG. 3) so that the winding and the permanent magnetic field can interact according to electromagnetic law to generate electrical energy. Alternatively, the turbine electric-power generating unit 206 can be replaced by a vibrating-type electric-power generating unit, in which the stream can cause a vibration of a vibrating piece to generate the electric power. In the example, the electric-power generating micro-device 208 can be, for example, a micro-turbine steam-powered generator that utilizes the steam flow inside the heat pipe to turn the turbine of the turbine electric-power generating unit 206. As the winding of the turbine electric-power generating unit rotates, an electric current is produced.

However, the foregoing setup is not the only feasible solution. In fact, other variations based on the electromagnetic principle of electricity generation are also permitted, such as vibrating-type electric generator. For example, the goal of generating electric power can be achieved by fixing the winding on the inner wall 202 and using the aforementioned turbine mechanism to rotate a permanent magnetic field.

Furthermore, a thermal sintering electrode structure 210 with two electrodes 210*a* and 210*b* conducts an electric current out of the heat pipe. In the provided examples such as FIG. 3, two electrodes 210*a* and 210*b*, serving as a pair, is shown as the example. However, it can have more than one pair of electrodes, depending on the actual design. The thermal sintering electrode structure 210 can be fabricated by applying the conventional metal sintering technique on ceramics (or glass) and metal so that the space inside the heat pipe can remain sealed and hermetic. Thus, the fabrication of the heat-pipe electric-power generating device of the present invention is completed. The details of fabricating the structure can be achieved using the conventional techniques as long as the basic rules according to the present invention are followed.

Because the magnet and the winding are made of metal, rusting and oxidation may occur if the fluid medium inside the heat pipe is water. However, if a suitable rust protection treatment is applied, this problem can be minimized so that the electric-power generating device inside the heat pipe can have a longer life.

In other words, the innovative design of the present invention can be manufactured using the conventional technique according to the actual design requirements.

Figure 4:
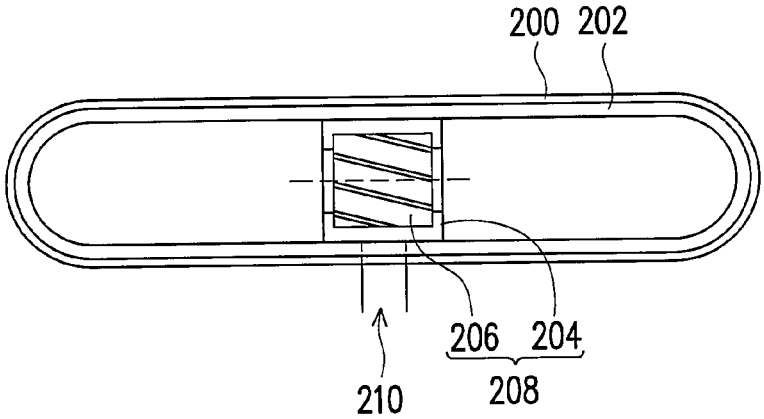
FIG. 4 is a schematic cross-sectional view showing the structure corresponding to the heat-pipe electric-power generating device in FIG. 3 according to one embodiment of the present invention.

FIG. 4 is a schematic cross-sectional view showing the structure corresponding to the heat-pipe electric-power generating device in FIG. 3 according to one embodiment of the present invention. As shown in FIG. 4, the turbine electric-power generating unit 206 generates electricity when a gas flow pushes and rotates the unit. However, the steam-flow electric-power generating micro-device 208 is not limited to a central position of the heat pipe. In general, any location that can fully utilize the steam flow is allowed. In addition, the heat pipe does not necessarily have a straight pipe design. Moreover, the heat pipe may be set in a direction perpendicular to the earth's surface to facilitate the return of condensed liquid by gravity during operation. Furthermore, the evaporating end 104 of the heat pipe is preferably set up near the lower end of the heat pipe for increasing the operating efficiency. Yet, this is not the only option.

Figure 5:
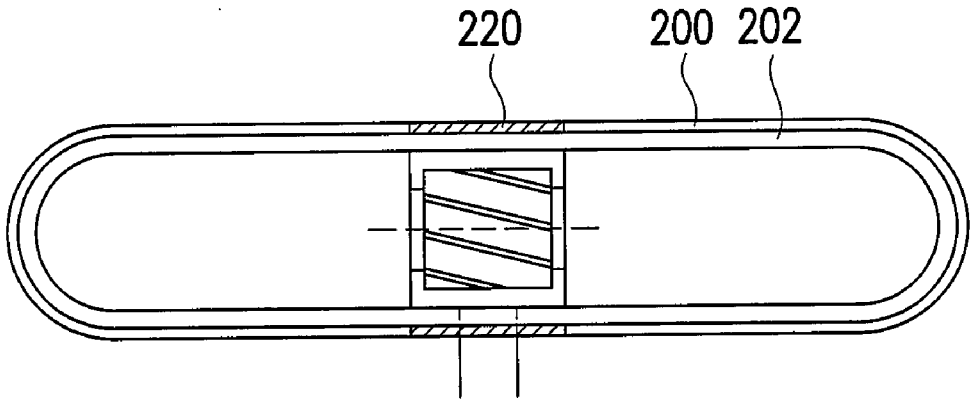
FIG. 5 is a schematic cross-sectional view of a heat-pipe electric-power generating device according to one embodiment of the present invention.

According to the same design rules depicted in FIG. 4, the pipe wall of the heat pipe can be suitably modified to facilitate manufacturing. FIG. 5 is a schematic cross-sectional view of a heat-pipe electric-power generating device according to one embodiment of the present invention. As shown in FIG. 5, the outer wall 200 of the heat pipe includes a first end wall, a second end wall and a connecting wall 220, for example, fabricated using glass or ceramic material. The connecting wall 220 can be used to support a steam-flow electric-power generating micro-device. For example, the connecting wall 220 and the steam-flow electric-power generating micro-device can be pre-fabricated before utilizing the thermal sintering technique to sinter the connecting wall 220 between the first end wall and the second end wall. Alternatively, the thermal sintering electrode structure can be pre-fabricated. Then, the pre-fabricated thermal sintering electrode structure is allowed to penetrate through the connecting wall 220 and electrically connect with the two electrodes of the steam-flow electric-power generating micro-device. Obviously, if the carrier for the steam-flow electric-power generating micro-device is separately manufactured, the outer capillary structure can be pre-fabricated in order to provide a continuous capillary structure in the inner wall. However, this is only a design variation. In other words, the design structures in FIG. 5 and FIG. 4 are just variations under the same design scheme. Furthermore, the designs in FIGS. 4 and 5 are not the only variation in the present invention.

Figure 6:
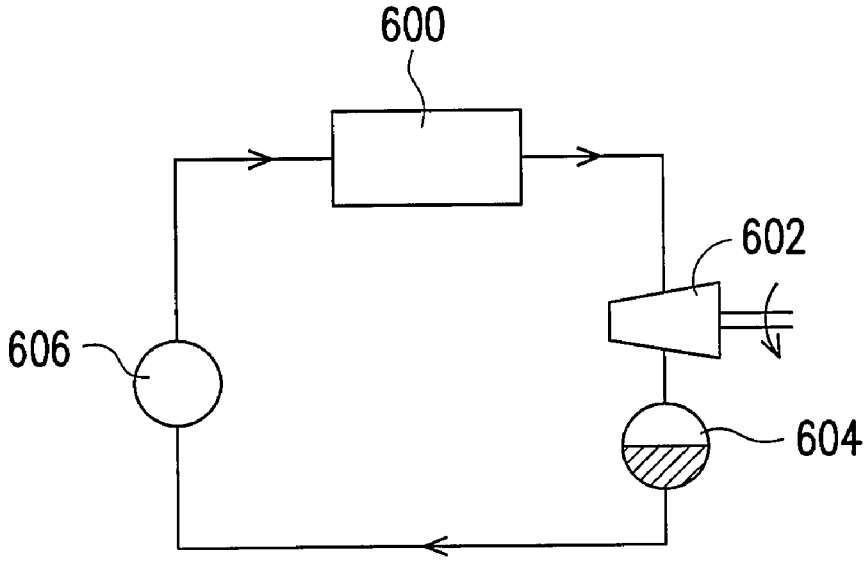
FIG. 6 is a diagram showing the conventional cyclic electrical power generating mechanism corresponding to the heat-pipe electric-power generating device of the present invention.

From the point of view of energy production, FIG. 6 is a diagram showing the conventional cyclic electrical power generating mechanism corresponding to the heat-pipe electric-power generating device of the present invention. As shown in FIG. 6, an energy production circuit includes, for example, an evaporating unit 600, a turbine electric-power generating unit 602, a gas condensation unit 604 and a pumping unit 606. The pumping unit 606 transfers condensed liquid to the evaporating unit 600. The evaporating unit 600 receives heat from a heat source and vaporizes the liquid to generate a steam flow. The steam flow pushes the turbine electric-power generating unit 602 to generate electrical energy.

Figure 7:
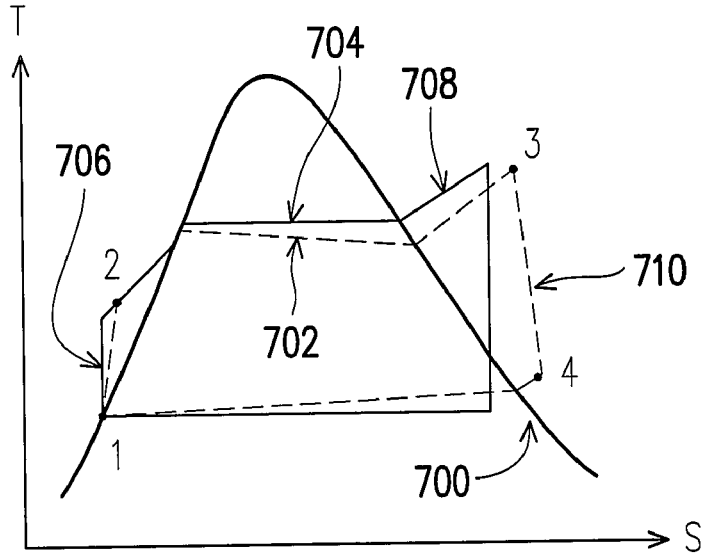
FIG. 7 shows the conventional thermal work diagram corresponding to the heat-pipe electric-power generating device of the present invention.

According to the principles of thermodynamics, the phase diagram of gaseous phase and liquid phase is shown in FIG. 7. FIG. 7 shows the conventional thermal work diagram corresponding to the heat-pipe electric-power generating device of the present invention. As shown in FIG. 7, the horizontal axis is the entropy S and the vertical axis is the temperature T. The area enclosed by a solid line 704 is an ideal Rankine cycle while the dash lines 702 passing through the points 1, 2, 3, and 4 is an actual Rankine cycle. The area above the saturated vapor curve 700 represents high pressure and the area on the left side of the peak represents liquid phase while the area on the right side of the peak represents gaseous phase. The area underneath the saturated vapor curve 700 represents a low pressure, a mixed area for liquid phase and gaseous phase. The path 706 from point 1 to point 2 has the characteristic of an isoentropic compression. The path 710 from point 3 to point 4 is the turbine electric-power generation portion. The area 708 is the gain produced by the heat source evaporator. Finally, at point 4, the gas starts to condense and returns to the point 1. The efficiency of the electric power generation will increase with the speed of the steam flow.

The steam-flow electric-power generating micro-device of the present invention is suitable for operating in an environment where there is sufficient heat energy. However, the heat energy is not limited to the recycling waste heat. For example, solar energy is also one of the natural energy resources that is actively developed at present. According to common understanding, solar energy is easily converted into heat energy. Therefore, the present invention can also utilize the heat energy produced by solar energy.

Figure 8:
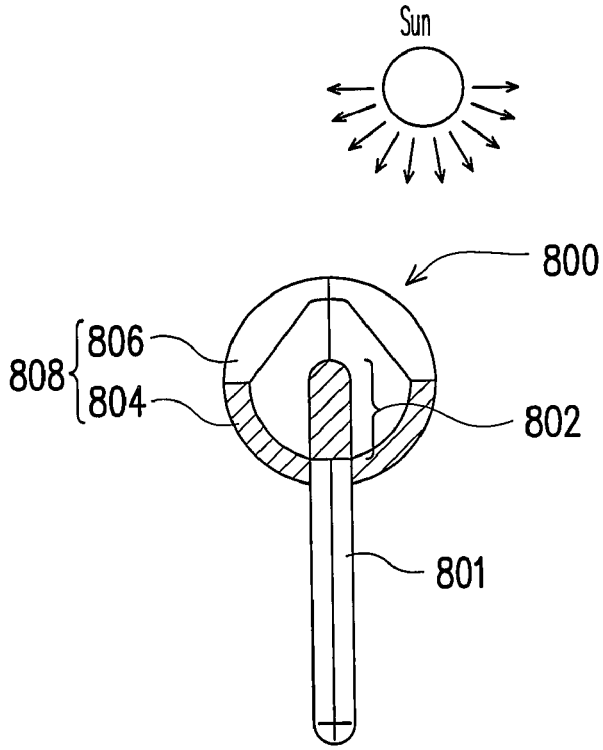
FIG. 8 is a schematic cross-sectional view of heat electric-power generating unit according to another embodiment of the present invention.

FIG. 8 is a schematic cross-sectional view of heat electric-power generating unit according to another embodiment of the present invention. As shown in FIG. 8, the heat electric-power generating unit 800 includes a heat pipe 801 that can be one of the aforementioned heat pipes. However, the evaporating end 802 further includes a solar energy absorbing structure 808 for absorbing heat energy. The solar energy absorbing structure 808 includes, for example, a focusing-reflecting element 804 capable of focusing the incoming sun light on the evaporating end 802 of the heat pipe 801. Furthermore, a transparent-focusing cover 806 can be disposed over the focusing-reflecting part 804. Aside from absorbing solar energy and converting into heat energy, the transparent-focusing cover 806 also reduces the amount of energy leaking away. Thus, the heat electric-power generator can also be a solar powered electricity generation device.

Figure 9A:
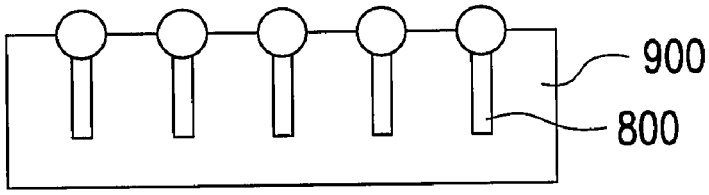
FIG. 9A is a schematic cross-sectional view of a heat electric-power generator according to another embodiment of the present invention.
Figure 9B:
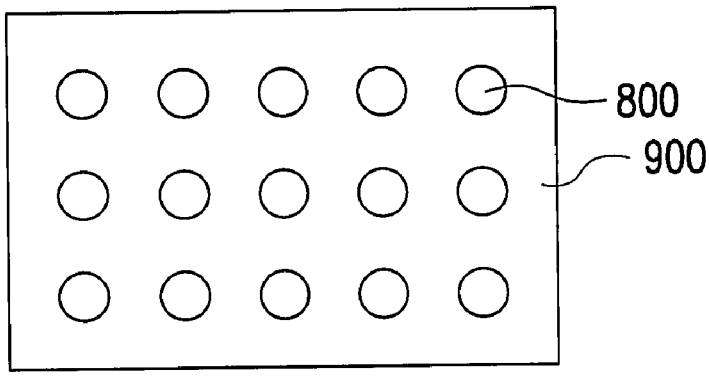
FIG. 9B is a top view of the heat electric-power generator shown in FIG. 9A.

Because a single heat electric-power generating unit 800 generates very little electrical energy, several heat electric-power generating units 800 are assembled to form an array inside an accommodating unit 900 as shown in FIGS. 9A and 9B as to increase power generation. The accommodating unit 900 has a heat source reception surface. A plurality of accommodating slots is distributed on the heat source reception surface for accommodating a corresponding number of heat electric-power generating units 800. In addition, the accommodating unit 900 also has an electric power collector for combining the electric power generated by the heat-pipe electric-power generating devices before outputting.

As shown in FIG. 9A, the heat electric-power generator can be disposed on any heat-generating device to produce a device with heat recycling capability. For example, the heat electric-power generator can be disposed inside a computer system, not only to remove the heat, but also to recycle the heat energy for other use. Another example of a device that generates a lot of waste heat is the air-conditioner. Thus, the heat electric-power generator according to the present invention can be incorporated to recycle the waste heat. Since there are a large number of similar applications, not every one of them can be listed.

Figure 10:
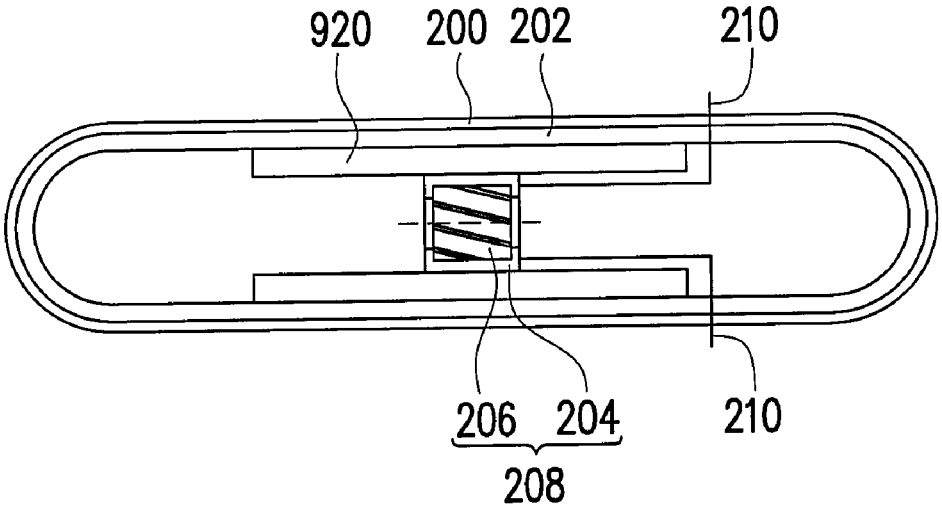
FIGS. 10-11 are cross-sectional views, schematically illustrating other embodiments, according to the present invention.
Figure 11:
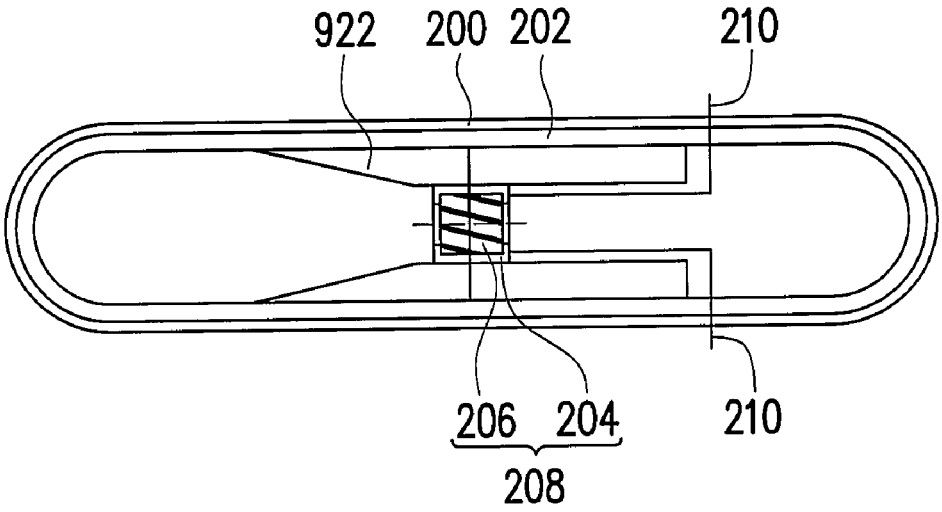

Under the same design principle, various embodiments are described as the examples. FIGS. 10-11 are cross-sectional views, schematically illustrating other embodiments, according to the present invention. In FIG. 10, a sleeve structure 920 can be further included at the middle section. The sleeve structure 920 can prevent the vapor from being condensed into liquid on the inner wall 202 at the middle section. This can assure that the generated steam is efficiently used. Further in FIG. 11, the sleeve structure 922 can also have, for example, a cone structure. The direction of the cone structure is at least at the side for receiving the steam, so that the steam can be converged to produce more driving momentum. The driving capability on the steam-flow electric-power generating device 208 can be further improved. Further, the electrodes 210 can be formed at the proper position by, for example, thermal sintering technique.

Figure 12:
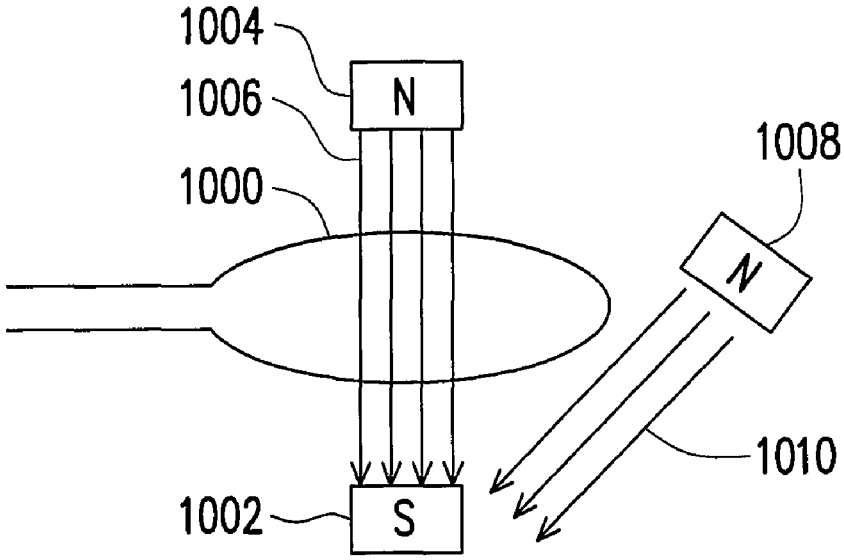
FIG. 12 is a schematic drawing, illustrating another mechanism to generate the electric power.

In the previous example, it is assumed that the rotor winding is rotating while the magnet is at fixed position. However, the electric power can be generated in alternative way. FIG. 12 is a schematic drawing, illustrating another mechanism to generate the electric power. In FIG. 12, when the winding 1000 is fixed with respect to the magnetic 1002, the magnetic field 1006 between the magnet 1002 and the magnet 1004 at the opposite position can produce more magnetic flux into the winding 1000. However, when the magnet 1008 at the other position, the magnetic field 1010 between the magnet 1002 and the magnet 1008 does not produce the magnetic flux into the winding 1000. In other words, when a rotating magnet is moving around the winding 1000, the magnetic flux is changing, so that the electric power can be generated.

Figure 13:
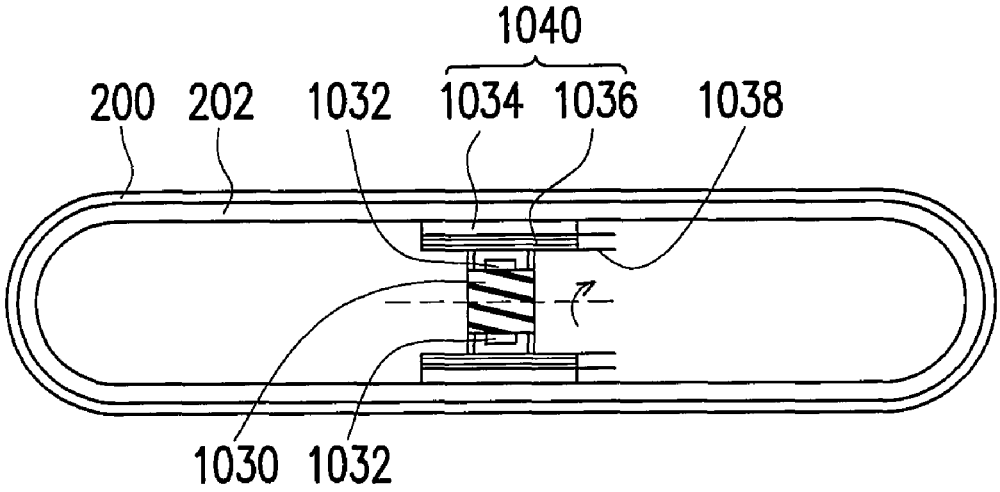
FIGS. 13-14 are cross-sectional views, schematically illustrating other embodiments, according to the present invention.
Figure 14:
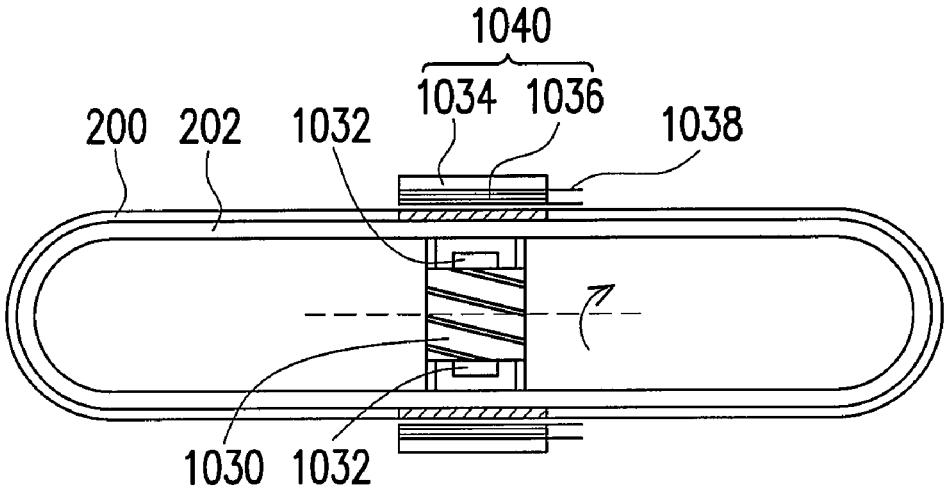

Based on the mechanism in FIG. 12, several alternative designs can be made. FIG. 13-14 are cross-sectional views, schematically illustrating other embodiments, according to the present invention. In FIG. 13, the at least one magnet can be formed over the inner wall 202. In the example of FIG. 13, two magnets 1034 are shown. Each magnet 1034 is implemented with a winding 1036, and each winding has a pair of electrodes 1038, which can be led out at the proper positions. The magnet 1034 with the winding 1036 can form a structure unit 1040 over the inner wall 202. Here, the sleeve as shown in FIG. 10-11 can also be implemented. The other at least one rotating magnet 1032 is implemented on the rotor 1030. As a result, the magnetic flux in each winding 1036 is varying, so as to generate the electric power.

Figure 15:
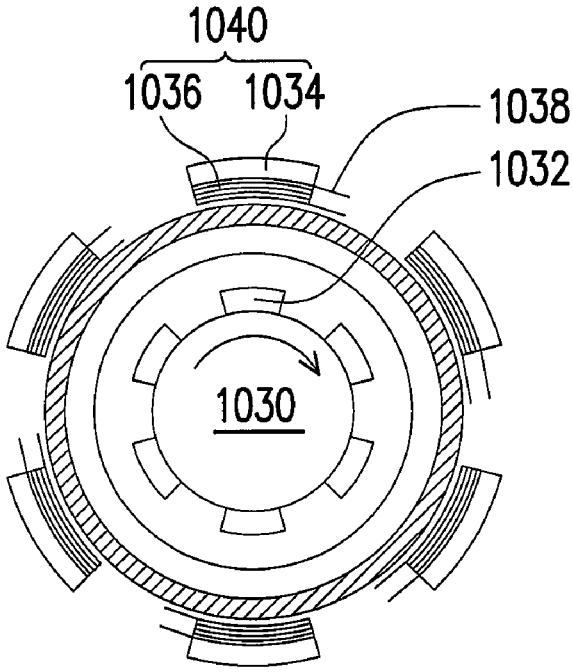
FIG. 15 is a cross-sectional view, illustrating the structure of the FIG. 14 in another cross-section.

In FIG. 14, in considering the design in FIG. 5, the structure unit 1040 with the magnet 1034 and the winding 1036 can be implemented over the outer wall 200. Here, since the glass material does not shield the magnetic field, the magnetic flux on the winding 1036 can still be generated for generating the electric power. In this situation the electrodes 1038 can be directly connected out without penetrating through the inner and outer walls. FIG. 15 is a cross-sectional view, illustrating the structure of the FIG. 14 in another cross-section. In FIG. 15, for example, several rotating magnet 1032 are implemented on the rotor 1030, which is driven by the steam. The outer magnets 1034 are also distributed over the outer wall with the material, such as the glass, which can be connected by, for example, sintering technique. The number of the inner and outer magnets can be one or more. Further, the windings 1036 can be connected in parallel or in cascade, depending on the actual design.

It should be noted that the embodiments as described above can also be properly combined into other designs. The steam-flow electric-power generating device is then generally referring to the design to produce the electric power by using the steam.

According to the heat-pipe electric-power generating device in one preferred embodiment of the present invention, the foregoing steam-flow electric-power generating micro-device can be a micro-turbine steam-powered generator.

According to the heat-pipe electric-power generating device in one preferred embodiment of the present invention, the foregoing thermal sintering electrode structure is a metal thermal sintering structure. The metal thermal sintering structure comprises at least a pair of electrodes penetrating the pipe wall of the heat pipe and electrically connects to the steam-flow electric-power generating micro-device.

According to the heat-pipe electric-power generating device in one preferred embodiment of the present invention, the foregoing steam-flow electric-power generating micro-device includes a rotor winding and a magnetic element capable of producing a magnetic field. Through the interaction between the rotating rotor winding and the magnetic field, electric power is produced.

According to the heat-pipe electric-power generating device in one preferred embodiment of the present invention, the foregoing pipe wall includes an outer wall whose evaporating end is in direct contact with an external heat source and an inner wall for returning the liquid cooled at the condensing end to the evaporating end to be vaporized again to generate a continuous steam flow.

According to the heat-pipe electric-power generating device in one preferred embodiment of the present invention, the outer wall of the pipe wall is one continuously sealed casing.

According to the heat-pipe electric-power generating device in one preferred embodiment of the present invention, the outer wall of the pipe wall includes a first end wall, a second end wall and a connecting wall. The connecting wall supports the steam-flow electric-power generating micro-device and connects with the first end wall and the second end wall. The thermal sintering electrode structure penetrates through the connecting wall and electrically connects with the two electrodes of the steam-flow electric-power generating micro-device.

According to the heat-pipe electric-power generating device in one preferred embodiment of the present invention, the evaporating end of the heat pipe is in contact with an external heat source and the condensing end of the heat pipe is in contact with an external heat-dissipating region.

According to the heat-pipe electric-power generating device in one preferred embodiment of the present invention, a light-to-heat converter is disposed at the evaporating end of the heat pipe for converting light energy into heat energy and hence serving as a heat source.

The present invention provides a new type of heat-pipe electric-power generating device having a simple heat pipe design and yet capable of collecting heat energy or actively utilizing heat energy to produce electrical energy. In particular, the present invention can convert solar energy into electrical energy. In other words, the present invention provides an effective method for processing heat energy.

Furthermore, the heat-pipe electric-power generating device of the present invention and its related applications also provides an overall consideration regarding the option of processing energy.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A heat-pipe electric-power generating device, suitable for converting heat energy or heat source energy into electrical energy, comprising:

a heat pipe, wherein the heat pipe has a sealed interior space capable of producing a steam flow from an evaporating end to a condensing end through a pressure difference between the ends of the heat pipe, wherein the heat pipe comprises:

an outer wall, of which the evaporating end directly contacts with an external heat source; and an inner wall of capillary material, disposed on the outer wall from inside for capillary transporting a liquid condensed at the condensing end to the evaporating end;

a steam-flow electric-power generating device, having a rotating portion and a fixed portion disposed on the heat pipe, wherein the rotating portion is driven by the steam flow to generate an electric power, wherein the rotating portion comprises a rotating magnet and the fixed portion comprises a plurality of magnet blocks separately disposed over the heat pipe and a winding respectively surrounding each of the magnet blocks;

a sleeve, disposed with directly contacting and fixing between the inner wall of capillary material and the steam-flow electric-power generating device, wherein the sleeve at a middle section of the heat pipe prevents the steam flow from condensing on the inner wall of capillary material at a section giving the sleeve in contact; and an electrode structure, coupled to the steam-flow electric-power generating device for leading the electric power out.

2. The heat-pipe electric-power generating device of claim 1, wherein the steam-flow electric-power generating device is a micro-turbine steam-powered generator or a vibrating-type steam-powered generator.

3. The heat-pipe electric-power generating device of claim 1, wherein the electrode structure is a metal thermal sintering structure comprising at least a pair of electrodes that penetrate through a pipe wall of the heat pipe and electrically connect to the steam-flow electric-power generating device.

4. The heat-pipe electric-power generating device of claim 1, wherein the magnet blocks are disposed on the heat pipe at outside.

5. The heat-pipe electric-power generating device of claim 1, wherein the outer wall of the heat pipe is one continuous sealed casing.

6. The heat-pipe electric-power generating device of claim 1, wherein the outer wall of the heat pipe comprises a first end wall, a second end wall and a connecting wall such that the connecting wall supports the steam-flow electric-power generating device and connects with the first end wall and the second end wall, and the electrode structure comprises a thermal sintering electrode structure which penetrates through the connecting wall and electrically connects to the steam-flow electric-power generating device; or a terminal structure connected to the winding outside the outer wall.

7. The heat-pipe electric-power generating device of claim 1, wherein the evaporating end of the heat pipe further comprises a light-to-heat converter for converting light energy into the heat energy of a heat source.

8. A heat electric-power generator, comprising:

an accommodating unit having a heat source reception surface with a plurality of accommodating slots distributed thereon to form an array; and a plurality of heat-pipe electric-power generating devices according to claim 1 disposed within the accommodating slots.

9. The heat electric-power generator of claim 8, further comprising an electric power collector for combining the electric power produced by each of the heat-pipe electric-power generating devices and outputting the total power.

10. The heat electric-power generator of claim 8, wherein the steam-flow electric-power generating device of each heat-pipe electric-power generating device is a micro-turbine steam-powered generator or a vibrating-type steam-powered generator.

11. The heat electric-power generator of claim 8, wherein the electrode structure of the steam-flow electric-power generating device is a metal thermal sintering structure comprising at least a pair of electrodes that penetrate through a pipe wall of the heat pipe and electrically connect to the steam-flow electric-power generating device.

12. The heat electric-power generator of claim 8, wherein the outer wall of the pipe wall is one continuous sealed casing.

13. The heat electric-power generator of claim 8, wherein the outer wall of the heat pipe comprises a first end wall, a second end wall and a connecting wall such that the connecting wall supports the steam-flow electric-power generating device and connects with the first end wall and the second end wall, and the electrode structure comprises a thermal sintering electrode structure which penetrates through the connecting wall and electrically connects to the steam-flow electric-power generating device; or a terminal structure connected to the winding outside the outer wall.

14. The heat electric-power generator of claim 8, wherein the evaporating end of the heat pipe further comprises a light-to-heat converter for converting light energy into the heat energy of a heat source.

15. An apparatus with heat energy (source) recycling capability, comprising:

a main unit for executing a prescribed function, wherein the main unit generates a waste heat source; and at least one of the heat-pipe electric-power generating device in claim 1 for converting the heat energy of the waste heat source into recycled electrical energy.

16. The apparatus of claim 15, wherein the steam-flow electric-power generating device of the heat-pipe electric-power generating device is a turbine steam-powered generator.

17. The apparatus of claim 15, wherein the thermal sintering electrode structure of the steam-flow electric-power generating device is a metal thermal sintering structure comprising at least a pair of electrodes that penetrate through a pipe wall of the heat pipe and electrically connect to the steam-flow electric-power generating device.

* * * * *